United States Patent [19]

Raskov

[11] Patent Number: 4,480,176

[45] Date of Patent: Oct. 30, 1984

[54] INSULATED ELECTRIC HEATING ELEMENT

[76] Inventor: Herman E. Raskov, 6312 Seward Park Ave. South, Seattle, Wash. 98118

[21] Appl. No.: 401,640

[22] Filed: Jul. 26, 1982

[51] Int. Cl.[3] ..... H05B 3/68

[52] U.S. Cl. ..... 219/461; 174/138 J; 219/347; 219/455; 219/460; 219/467; 219/532; 219/536; 219/550

[58] Field of Search ..... 219/345, 342, 347, 354, 219/455, 458–464, 467, 468, 532, 536, 537, 550, 611, 438, 439, 530, 540; 174/138 J

[56] References Cited

U.S. PATENT DOCUMENTS

| | | | |
|---|---|---|---|
| 1,049,488 | 1/1913 | Hughes et al. | 219/460 X |
| 1,472,201 | 10/1921 | Woodson | 219/461 |
| 1,819,537 | 8/1931 | Berry | 219/550 |
| 2,022,466 | 11/1935 | Hess | 219/550 |
| 2,091,905 | 8/1937 | Bensel et al. | 219/461 |
| 2,658,984 | 11/1953 | Mohn | 219/354 |
| 2,662,158 | 12/1953 | Vallorani et al. | 219/455 |
| 2,747,070 | 5/1956 | Bargchr | 219/550 X |
| 2,822,456 | 2/1958 | Glynn | 219/345 |
| 2,836,698 | 5/1958 | Fry | 219/461 |
| 2,907,873 | 10/1959 | Smith | 219/347 |
| 2,963,539 | 12/1960 | Hynes | 174/138 J |
| 3,052,789 | 9/1962 | Trainor | 219/347 |
| 3,086,101 | 4/1963 | Scofield | 219/460 |
| 3,322,946 | 5/1967 | Cooper | 219/347 |
| 3,358,074 | 12/1967 | Himes | 174/138 J |
| 3,363,090 | 1/1968 | Langley | 219/540 |
| 3,471,680 | 10/1969 | Kelm | 219/342 |
| 3,471,682 | 10/1969 | Hisey et al. | 219/354 X |
| 3,668,303 | 6/1972 | Alexander | 174/138 J |
| 4,115,918 | 9/1978 | Anderi | 219/438 X |
| 4,311,899 | 1/1982 | Goessler | 219/461 |

FOREIGN PATENT DOCUMENTS

| | | | |
|---|---|---|---|
| 929803 | 7/1955 | Fed. Rep. of Germany | 219/461 |

*Primary Examiner*—Volodymyr Y. Mayewsky
*Attorney, Agent, or Firm*—Christensen, O'Connor, Johnson & Kindness

[57] ABSTRACT

An insulated electric heating element particularly suitable for use in a hot plate or electric stove is disclosed. The insulated electric heating element includes an insulating member comprising a layer of ceramic insulation surrounding the sides and bottom of the housing that encloses the resistive heating element is disclosed. The ceramic insulation is mounted in the bottom and extends up the sides of a cross-sectionally U-shaped channel. The legs of the channel are formed so as to adhere to the sides of the heating element housing. The ceramic insulation reduces the heat radiated downwardly and sidewardly and, correspondingly, increases the heat radiation upwardly by the electric heating element. The upper edge of the channel legs lie below the upper surface of the heating element housing to avoid creating a gap between the bottom of a vessel (e.g., pot) to be heated and the upper surface of the heating element housing. Further, preferably, the upper surface of the ceramic insulation is covered with a layer of reflective material that reflects heat, radiated from the heating element housing toward the layer of ceramic insulation, back toward the heating element housing.

7 Claims, 6 Drawing Figures

INSULATED ELECTRIC HEATING ELEMENT

TECHNICAL AREA

This invention relates to electric heating elements and, more particularly, electric heating elements usable in hot plates, stoves, etc.

BACKGROUND OF THE INVENTION

Electric heating elements of the type widely used in electric hot plates and stoves include a resistive heating element enclosed by a shell-like housing. The housing is supported by several arms that, in turn, are supported by a saucer or cup designed to catch debris running down the side of a vessel being heated. Such debris catchers are designed to be easily removed for cleaning.

During heating, the vessel to be heated (e.g., pot) is placed atop the horizontally arrayed heating element housing. Electric power applied to the resistive heating element heats the vessel lying atop the heating element housing. While the purpose of the heating element is to heat the vessel lying on the upper surface of the heating element housing, in addition to radiating upwardly toward the vessel, heat is also radiated downwardly and sidewardly. While, some of the downward and sideward radiated heat ultimately assists in heating the vessel (because heat flows upwardly) some of the downward and sideward radiated heat is lost. For example, part of the heat is lost by the debris collecting cup or saucer (which is usually formed of metal) being heated and conducting part of the heat energy received away from the area underlying the vessel being heated. This invention is directed to avoiding this and other heat losses due to heat radiation away from the vessel to be heated.

SUMMARY OF THE INVENTION

In accordance with this invention an insulated electric heating element is provided. The electric heating element is provided by surrounding the sides and bottom of the housing of a heating element with a layer of insulation, preferably a ceramic insulation. The insulation is mounted in the bottom and extends up the sides of a cross-sectionally U-shaped channel. The legs of the channel attach to the sides of the heating element housing, whereby the insulation reduces heat radiation downwardly and sidewardly and, correspondingly, increases heat radiation upwardly. The upper edges of the channel legs lie below the upper surface of the heating element housing to avoid creating a gap between the bottom of the vessel (e.g., pot) to be heated, and the upper surface of the heating element housing.

Insulated electric heating elements formed in accordance with the invention can be created in two different ways. First, the insulation and U-shaped channel support can form an insulating member suitable for attachment to electric heating element housings during the manufacture thereof. Alternatively, the U-shaped channel and insulation can be formed into a replaceable insulating member designed to fit previously manufactured electric heating elements. In the case of newly manufactured electric heating elements, the insulating member can be formed in a continuous manner that conforms to the shape of the heating element (e.g., spiral) and the supports for the heating element can be designed to receive the bottom of the U-shaped channel rather than the bottom of the heating element housing. In the case of previous manufactured heating elements supported by supports designed to receive the bottom of a heating element housing, the insulating member can be formed in segments adapted to fit between the supports. Further, end hangers can be provided for supporting the ends of the insulating element segments.

In accordance with further aspects of the invention, the legs of the U-shaped channel are attached to the sides of the heating element housing in various ways. In this regard, most conventional heating element housings include a beveled corner between the upper surface of the heating element housing and the side walls thereof. The beveled corner is used to support the U-shaped channel by tapering the upper edge of the legs of the U-shaped channel inwardly and resting the tapered regions on the beveled corners of the heating element housing. Attachement force can be increased by serrating the edge of the tapered edges of the U-shaped channel legs and/or creating dimples in the beveled corners of the heating element housing for receiving the tips of the serrations. Still further, an elongate channel adapted to receive the tapered ends of the U-shaped channel can be formed in the beveled corners of the heating element housing. Finally, if desired, rather than being curved to conform to the curved shape of a heating element housing, the U-shaped channel can be multi-sided. When a multi-sided channel is applied to a continously curved heating element housing, attachment friction force is created by the difference in geometrical configuration. When formed in any of these manners the U-shaped channel can be readily separated from the heating element for replacement should this become necessary.

In accordance with further aspects of this invention, the amount of heat passing through the insulating element and, thus lost, is decreased by coating the surface of the insulation facing the heating element housing with a reflective material.

As will be readily appreciated from the foregoing description, the invention provides an insulated electric heating element. Because heat radiation downwardly and sideways is substantially reduced, the amount of heat radiated upwardly and, thus, directly applied to the vessel to be heated, is increased. The end result is that the vessel and its contents are heated to a desired temperature for a lower electrical energy cost. The invention is not only suitable for use in the production of new electric heating elements, it is also useful in improving the usable heat output of previously manufactured electric heating elements.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein.

DESCRIPTION OF THE PREFERRED EMBODIMENT

Figure 1:
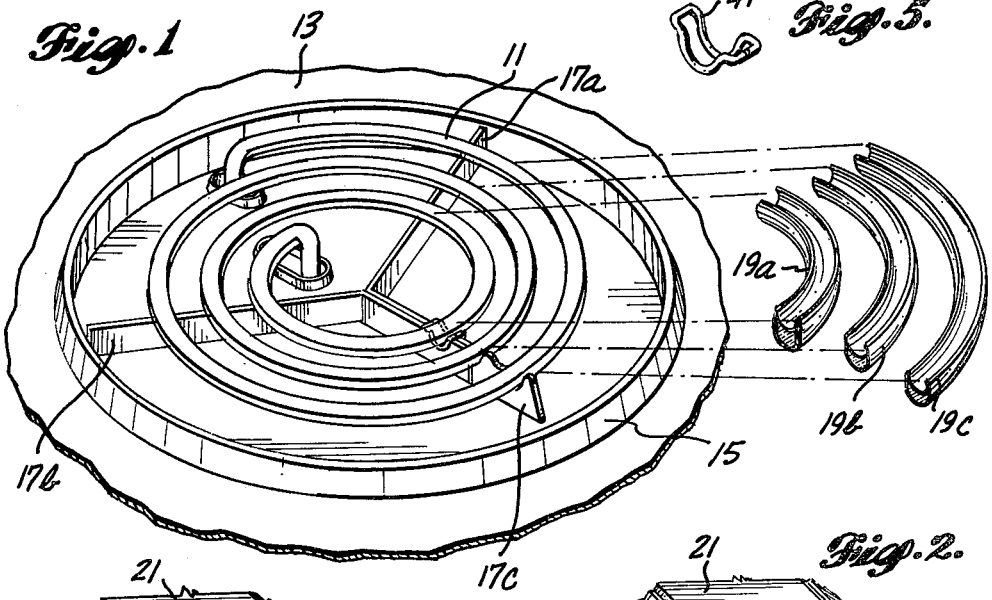
FIG. 1 is a pictorial view of an electric heating element and a support therefore of the type included in previously manufactured hot plates and electric stoves, plus a segmented insulating member formed in accordance with the invention suitable for application to such heating elements.

FIG. 1 illustrates a spirally shaped elongate electric heating element 11 mounted atop a hot plate or stove 13. More specifically, the hot plate or stove 13 supports a cup or saucer shaped debris catcher 15 in a suitably sized round hole formed in the hot plate or stove 13. The debris catcher 15 supports three radial support arms 17*a*, 17*b*, and 17*c*. One or more of the support arms 17*a*, 17*b*, and 17*c* have notched upper edges. The spiral heating element 11 lies in the notches. The spiral heating element is a conventional electric heating element of the type included in many previously manufactured hot plates and stoves and includes a shell-like housing 21 surrounding a resistive heating element 23 (see FIGS. 2 through 4).

The notches in the support arms 17*a*, 17*b*, and 17*c*, are shaped to conform to the sidewalls and bottom of the housing 21 of the heating element and sized such that the flat upper surface of the heating element lies slightly above the upper edges of the support arms 17*a*, 17*b*, and 17*c*. Thus, when a vessel to be heated is positioned atop the heating element, the vessel rests on the heating element housing 21, not on the upper edges of the support arms. Hence, no gap is created between the heating element 11 and the vessel.

When a heating element of the type illustrated in FIG. 1 and just described is energized by a suitable source of electrical energy, heat is radiated not only from the top of the heating element, but also downwardly and sidewardly. While some of the downward and sideward heat radiation rises and ultimately increases the temperature of the vessel, much of this heat is lost. Some of the lost heat is received by the debris catcher 15 from which it is conducted away from the vessel by the upper surface of the stove 13. This heat is then radiated by the stove, away from the vessel to be heated. As a result, more electrical energy than desirable is required to heat the vessel (and its contents). The invention is directed to reducing this and similar types of heat loss and, thus, the cost of the energy required to heat vessels positioned atop electric heating elements.

As illustrated in the drawings, the invention contemplates insulating the bottom and sidewalls of a heating element housing 21 to reduce the amount of heat radiated downwardly and sidewardly when the resistive heating element 23 is energized. In the case of a previously manufactured heating element 11, the invention contemplates providing a segmented insulating member to accomplish this result. In this regard, as shown in FIG. 1, the insulating member segments 19*a*, 19*b*, and 19*c* are sized so as to fit the arcuate sections of the spiral heating element 11 lying between the support arms 17*a*, 17*b*, and 17*c*. In the case of newly manufactured hot plates and stoves, the invention contemplates the provision of a continuous insulating member designed to conform to the configuration of the heating element and the creation of notches in the support arms configured to receive the insulating member rather than the heating element housing. The continuous insulating member can be formed so as to be removably attached to the heating element housing in the same manner as a segmented insulating member (described below) or permanently attached to the heating element during manufacture.

Figure 3:
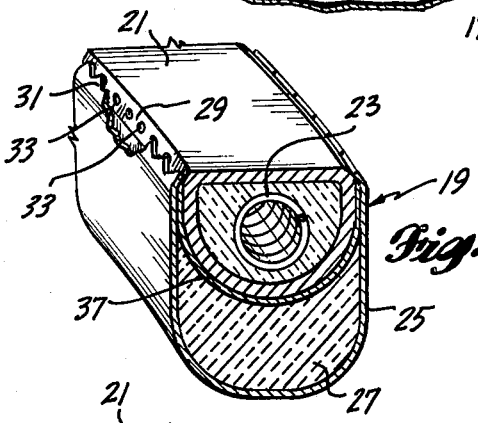
FIG. 3 illustrates an alternative way of attaching an insulating member formed in accordance with the invention to an electrical heating element housing.
Figure 2:
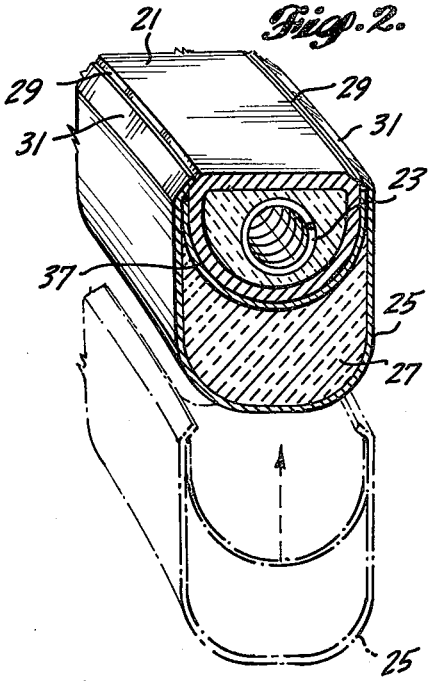
FIG. 2 is a cross-sectional, partial, perspective view illustrating one manner of attaching an insulating member formed in accordance with the invention to an electric heating element housing.
Figure 4:
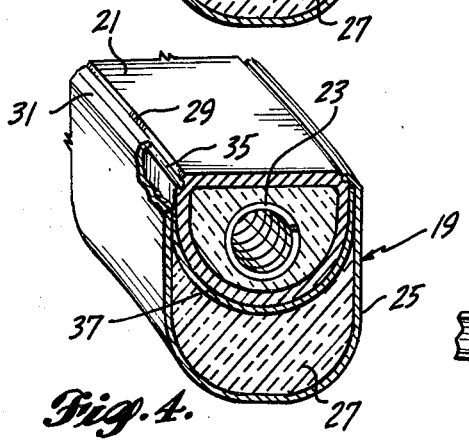
FIG. 4 illustrates a further alternative way of attaching an insulating member formed in accordance with the invention to an electrical heating element housing.

As shown in FIGS. 2 through 4, the insulating member 19, regardless of whether it is segmented or continuous, includes a U-shaped channel 25. The channel 25 houses a high-temperature insulation 27. Preferably, the high-temperature insulation is a ceramic insulation. In any case, the high-temperature insulation fills the bottom and extends at least partially up the sidewalls of the U-shaped channel 25. The region above the insulation 27 is sized to receive a heating element housing 21. More specifically, the legs of the U-shaped channel are spaced apart by an amount equal to or slightly greater than the distance between the sidewalls of the heating element housing 21. In addition, the depth of the region between the sidewalls of the channel 25 is greater than the height of the heating element housing.

As will be readily appreciated by those familiar with electric heating elements, most conventional electric stove and hot plate heating element housings include a flat upper surface, short, almost nonexistent, sidewalls and a semicircular bottom. Located between the sidewalls and the flat upper surface of the heating element housing 21 are beveled corners 29. In accordance with the invention, the beveled corners are used to assist sidewall friction in attaching the insulating member to the heating element housing. In this regard, as illustrated in FIGS. 2–4, the tips of the legs of the U-shaped channel 25 are tapered inwardly 31. When attached to a heating element housing the tapered region of the legs lie atop the beveled corners 29 of the electric heating element housing 21. The material used to form the U-shaped channel (preferably metal) is resilient. The resiliency is such that the insulating member 19 must be "snapped" in place. After being snapped in place, the resiliency of the channel 25 prevents the insulating member 19 from dropping away from the heating element housing 21 due to gravity.

As illustrated in FIG. 3, the insulating member attachment force can be increased by creating a plurality of longitudinally aligned dimples 33 in the beveled corners 29 of the heating element housing 21 and/or serrating the edge of the tapered tip 31 of the legs of the U-shaped channel 25. FIG. 4 illustrates an alternative way of increasing the attachment force. Specifically, FIG. 4 illustrates an elongate slot 35 formed in each of the beveled corners 29 of the heating element housing 21. The edge of the tapered tip 31 of the legs of the U-shaped channel 25 are bent inwardly so as to create protrusions adapted to fit into the slots 35.

Preferably, the inner surface of the insulation 27, i.e., the surface of the insulation 27 facing the bottom and sidewalls of the heating element housing 21, is coated with a layer of reflective material 37. The reflective material reflects heat back toward the heating element housing 21. As a result, for a specified amount of insulating material 27, less heat loss occurs through the insulating material and the U-shaped channel as compared to the heat loss through these items of an insulating member that does not include a reflective layer 37.

Figure 5:
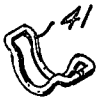
FIG. 5 is a pictorial view illustrating a clip suitable for use in supporting the ends of a segmented insulating member of the type illustrated in FIG. 1; and, FIG. 6 is a partial, top plan view of a multi-sided embodiment of an insulating member formed in accordance with the invention.

FIG. 5 illustrates a hanger 41. The hanger 41 is a "wire" hanger having semicircular sides joined by cross-members. The hanger 41 is adapted to hang over the support arms 17*a*, 17*b*, and 17*c* and provide end support for insulating member segments 19*a*, 19*b*, and 19*c*. More specifically, the cross-members of the hangers 41 lie atop the radial arms 17*a*, 17*b*, and 17*c* and the semicircular sides support the ends of the segments 19*a*, 19*b*, and 19*c*. While only three insulating member segments are actually illustrated in FIG. 1, it is to be understood that segments are to be included in all of the arcuate sections defined by the radial support arms 17*a*, 17*b* and 17*c*.

Figure 6:
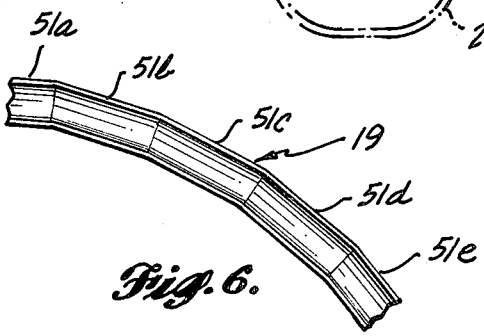

FIG. 6 illustrates an alternative way of increasing the friction support between an insulating member 19 and a heating element housing 21. Specifically, FIG. 6 illustrates forming the insulating member 19 such that it is multi-sided 51*a*, *b*, *c*, etc. rather than curved. The sides 51*a*, *b*, *c*, etc. create friction force when the insulating element is attached to a heating element due to the dissimilarity between the configurations.

As will be readily appreciated from the foregoing description, the invention provides an insulated electric heating element. In essence, the invention provides insulating members suitable for attachment to (or manufactured as part of) an electrical heating element. In this regard, while shown as designed for attachment to a spiral heating element 11, obviously, insulating members designed for attachment to other shapes of heating elements fall within the scope of the invention. Further, in the case of insulating members designed for attachment to previously manufactured heating elements, rather than being created as a series of segments, the insulating member could take the form of a continuously curved (spiral or otherwise) structure having "score" lines for breaking the structure into segments sized by the configuration of the heating element to which the insulating member is to be attached. Further, it is to be understood that the insulating member designed for attachment to pre-existing heating elements is replaceable. Replacement may be required if, after prolonged use, the insulating properties of the insulation deteriorates or the legs of the U-shaped channel lose their resiliency, whereby the insulating member drops away from intimate contact with the bottom and sidewalls of the heating element housing. Thus, while preferred embodiments of the invention have been illustrated and described, it will be appreciated that various changes can be made therein without departing from the spirit and scope of the invention. Consequently, the invention can be practiced otherwise than as specifically described herein.

The preferred embodiments of the invention in which an exclusive property or privilege is claimed are defined as follows:

1. An insulated, electric heating element suitable for use in an electric heating system designed to emit heat in a predetermined direction comprising:

(A) an elongate, electric heating element including an electric resistive heating element surrounded by a heating element housing, the cross-sectional configuration of said heating element housing including a flat side, sidewalls lying generally orthogonal to said flat side and beveled regions extending between said sidewalls and said flat side; and, (B) an insulating member attached to said heating element housing along the entire length thereof on the sides thereof facing away from said predetermined direction for reducing the heat emitted by said elongate, electric heating element in directions other than said predetermined direction, said insulating member comprising:

(1) a channel of impervious material having a U-shaped cross-sectional configuration and a longitudinal configuration similar to the longitudinal configuration of said heating element housing, the edges of the legs of said U-shaped channel being tapered inwardly, said inward tapering edges impinging on said beveled region of said heating element housing; and, (2) insulating material mounted in said channel between the legs and cross-member thereof, the cross-sectional configuration of said channel and said insulating material being sized and located such that a region is formed between said insulating material and the legs of said channel suitable for receiving said heating element housing.

2. An insulated electric heating element as claimed in claim 1 wherein said insulating member is formed of a plurality of segments.

3. An insulated electric heating element as claimed in claim 1 wherein said beveled regions of said electric element housing are dimpled.

4. An insulated electric heating element as claimed in claim 3 wherein said tapered edges of said U-shaped channel are serrated.

5. An insulated electric heating element as claimed in claim 1 wherein said tapered edges of said U-shaped channel are serrated.

6. An insulated electric heating element as claimed in claim 1 including longitudinal slots formed in said beveled regions of said electric heating element housing and wherein said tips of said tapered edges of said U-shaped legs are curved inwardly so as to fit into said slots in said beveled regions of said electric heating element housing.

7. An insulated electric heating element as claimed in claim 1 wherein said electric heating element has a curved configuration and wherein said insulating member is multi-sided.

* * * * *

UNITED STATES PATENT AND TRADEMARK OFFICE

CERTIFICATE OF CORRECTION

PATENT NO. : 4,480,176

DATED : October 30, 1984

INVENTOR(S) : Herman E. Raskov

It is certified that error appears in the above-identified patent and that said Letters Patent is hereby corrected as shown below:

Column 2, line 16: "Attachement" should be — Attachment —.

line 26: "continously" should be — continuously —.

Column 6, line 37: After "electric" insert — heating —.

Signed and Sealed this

*Fourteenth* Day of *May 1985*

[SEAL]

*Attest:*

DONALD J. QUIGG

*Attesting Officer* *Acting Commissioner of Patents and Trademarks*